United States Patent [19]

Bloemer

[11] Patent Number: 5,015,024

[45] Date of Patent: May 14, 1991

[54] CARRIAGE FOR A STRETCHER

[75] Inventor: Guenter Bloemer, Bergisch Gladbach, Fed. Rep. of Germany

[73] Assignee: Stollenwerk Fabrik fur Sanitatsaustungen Hans Stollenwerk & Cie GmbH & Co., Fed. Rep. of Germany

[21] Appl. No.: 568,988

[22] Filed: Aug. 17, 1990

[30] Foreign Application Priority Data

Aug. 19, 1989 [DE] Fed. Rep. of Germany ..... 3927484

[51] Int. Cl.[5] ..... A61G 1/02

[52] U.S. Cl. ..... 296/20; 280/767; 5/81 R

[58] Field of Search ..... 296/20; 280/767, 761; 5/81 R, 81 B, 86

[56] References Cited

U.S. PATENT DOCUMENTS

| | | | |
|---|---|---|---|
| 3,759,565 | 9/1973 | Ferneau | 296/20 |
| 4,767,148 | 8/1988 | Ferneau et al. | 296/20 |
| 4,776,415 | 10/1988 | Brice | 280/767 X |
| 4,921,295 | 5/1990 | Stollenwerk | 296/20 |

*Primary Examiner*—Robert R. Song

*Attorney, Agent, or Firm*—Neil F. Markva

[57] ABSTRACT

The carriage of the present invention includes front and rear legs pivotally mounted to a frame. The front legs include first roller members mounted to carry the frame along a first directional path and steering roller members are mounted to the rear legs for carrying the frame along a plurality of directional paths to effect steering of the carriage. In addition to the first roller means, the front legs include front steering roller members which are also mounted to carry the frame along a plurality of directional paths transverse to the first directional path to effect steering at the front of the carriage. The front legs may be locked in a plurality of pivotal positions in which the front end of the carriage will rest either only on the first roller members or the front steering roller members. The location of the first roller members and the front steering roller members with respect to each other on the front legs is effective to cause only the first roller members to support the frame when the front legs are in one of the pivotal positions and to cause only the front steering roller members to support the frame when the front legs are in another of the pivotal positions for the front legs.

12 Claims, 4 Drawing Sheets

CARRIAGE FOR A STRETCHER

FIELD OF THE INVENTION

The invention relates to a carriage for a stretcher comprising a frame, front legs pivotably provided thereon and having castors, and a disengageable locking device for locking the front legs at the frame in at least two pivotal positions.

BACKGROUND OF THE INVENTION

Such a carriage for a stretcher is known from U.S. Pat. No. 4,921,295. While the front legs at the front end or the frame have fixed, i.e. unpivotable castors (rollers), the rear legs are provided with pivotable steering rollers so that the carriage may be guided while being pushed. In order to bring a patient in shock into an appropriate position on the stretcher while moving the latter by means of the carriage, the front legs may be locked at the frame in at least two pivotal positions by means of disengagable locking device. In the one pivotal position, the front legs are pivoted down completely; this position is usually taken by the front legs when the carriage is moved. Additionally, the front legs may be locked in a second pivotal position wherein their angle to the frame is more acute than in the first position so that the front end of the carriage is lowered as necessary for positioning persons in shock.

Although the known carriage is provided with steering rollers, its maneuverability is limited. In narrow halls full of nooks and crannies, moving the carriage is difficult since a steering only by the rear steering rollers is not sufficient at narrow corners. Further, a lateral displacement of the carriage is impossible without a troublesome moving of the carriage back and forth and without maneuvering or lifting the same. When lifting the carriage, there is the danger that the patient is subjected to painful vibrations.

If the front rollers were replaced with pivotable castors, the carriage could hardly be controlled, if at all, when being moved on sloping surfaces. Further, the trailing necessary with guide rolls (i.e. the vertical pivot axis of the steering rollers lies ahead of the horizontal rotational axis of the steering rollers with respect to the direction of movement) would be disadvantageous when lowering the front end since, with the front legs inclined, the own weight of the carriage would exert a rotational moment on the steering rollers that would result in an undesired rotation of the steering roller about the pivot axis and keep the guide rollers in their forward movement position.

On the other hand, the castors at the front legs have to be designed unpivotable since it is necessary to be able to move the carriage exactly onto the loading platform of an ambulance. The solution of this problem, providing each front leg with a castor that may be locked in the forward position, is not practicable since the rotational moment, caused by the trailing of the steering rollers when the front end is lowered, would exert extremely great forces on the lock of the steering rollers, which would result in a rather high wear.

SUMMARY OF THE INVENTION

It is an object of the invention to provide a carriage of the type mentioned before, which is easy to maneuver, but still has the advantages of a carriage having upivotable castors at the front legs.

The solution to this object, as suggested by the present invention, provides the front legs with pivotable steering rollers in addition to the fixed rollers, which are arranged such that, in the one pivotal position of the front legs, the frame will rest only on the fixed rollers, while, in the other pivotal position of the front legs, it will rest on the front steering rollers only.

According to the present invention, each front leg has an unpivotable or fixed roller and a pivotable steering roller. The first fixed roller is mounted to carry the frame along a first directional path and the pivotable front steering roller is mounted to carry the frame along a plurality of directional paths transverse to the first directional path. Depending on the pivotal position of the front legs, the frame (besides the rear steering rollers of the rear legs) may be moved either by means of the front fixed rollers or the front steering rollers. In the pivotal position in which the front end or the carriage rests on the fixed rollers, the front legs are advantageously pivoted down completely, i.e. they are in that pivotal position in which the carriage is moved to the platform of an ambulance.

In order to move the carriage by the front steering rollers, the front legs are brought into the second lockable pivotal position. Now, the front fixed rollers are out of contact with the ground, which is true for the steering rollers in the first pivotal position of the front legs. Advantageously, the second lockable pivotal position of the front legs is chosen such that the front end of the carriage is lowered only slightly so that a patient is transported in a substantially horizontal position. However, it is also possible to choose that position of the front legs as the second pivotal position, in which the carriage takes an inclined position for accommodating a person in shock.

With a rather simple construction, the carriage of the present invention solves the problem to achieve, it need be, an increased maneuverability of the carriage by providing steering rollers at the front legs, without having to do without the front fixed rollers and their advantages. Changing over from the unpivotable castors of the carriage according to the present invention to the pivotable steering rollers by simply pivoting the front legs is favorable to the user and easier to do than the locking and the disengaging of front steering rollers that may be locked in the rotational position for straight forward movement.

It is also possible within the scope of the invention to replace the steering roller of a front leg by a rotatably supported ball that may be rotated about three mutually perpendicular rotational axes. To achieve this, the ball is accommodated in a ball bearing, the surface of the ball being partially left uncovered. According to the present invention, such a ball is also understood by a pivotable front steering rollers.

Advantageously, the steering rollers have the same track width as the fixed rollers, the steering rollers being arranged at the front legs such that they are located between the front fixed rollers and the rear steering rollers when the front and rear legs are pivoted down. In this embodiment of the invention, the front steering rollers do not project beyond the front fixed rollers, neither inward nor outward. On the one hand, this has the advantage that the space between the fixed rollers remains free, which is a precondition for a low constructional height of the carriage when folded. On the other hand, the fact that the front steering roller is in flush with the front roller has the advantage that the carriage shows no parts projecting beyond the rollers, thus being of minimum width.

A solution of simple construction for the bearing of the steering rollers and the fixed rollers at the front legs is achieved by supporting the steering rollers at the supports of the fixed rollers. Herein, the live ring of a steering roller is mounted at the support of an associated front roller. Thus, the structure of the carriage according to this embodiment has an increased stability.

According to another advantageous embodiment of the invention, the supports of the front steering rollers are adjustably arranged at the front legs or at the supports of the front roller members. In this way, one may change the relative position between the supports of the steering rollers and the rollers at the front legs. This is particularly advantageous if the front legs are adjustable in length so that the carriage may be adapted to the different heights of platforms of different ambulances. With the length of the front legs changed (extended and shortened), the frame is brought into a horizontal position by locking the rear legs in another pivotal position (a more rectangular or acute angle with respect to the frame).

Due to the different inclined positions of the rear legs, the frame is lowered to different extents when the front legs are in their second pivotal position. Therefore, the pivot axis of the front steering rollers, on which the front end of the frame rests in the second pivotal position of the front legs, is not rectangular or perpendicular to the ground when the length or the front legs is changed. This is disadvantageous because of the trailing property necessary for steering rollers, since, in such a case, a torque acts on a steering roller that will cause a rotation of the steering roller by approximately 180°. With the adjustability of the position of the front steering rollers supports relative to the front legs, the front steering rollers may be adjusted such that their pivot axes are always perpendicular to the ground, even when the length of the front legs is varied for adaptation of the carriage to the different heights of platforms.

According to a further advantageous embodiment of the invention, it is provided that in case of front legs variable in length, the perpendicular extension of the pivot axis of the front steering rollers may also be realized by making the front legs lockable in several pivotal positions in which the frame rests on the front steering rollers only (besides the rear steering rollers at the rear legs). In this case, the adjustable mounting of the supports for the front steering rollers may be dropped.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
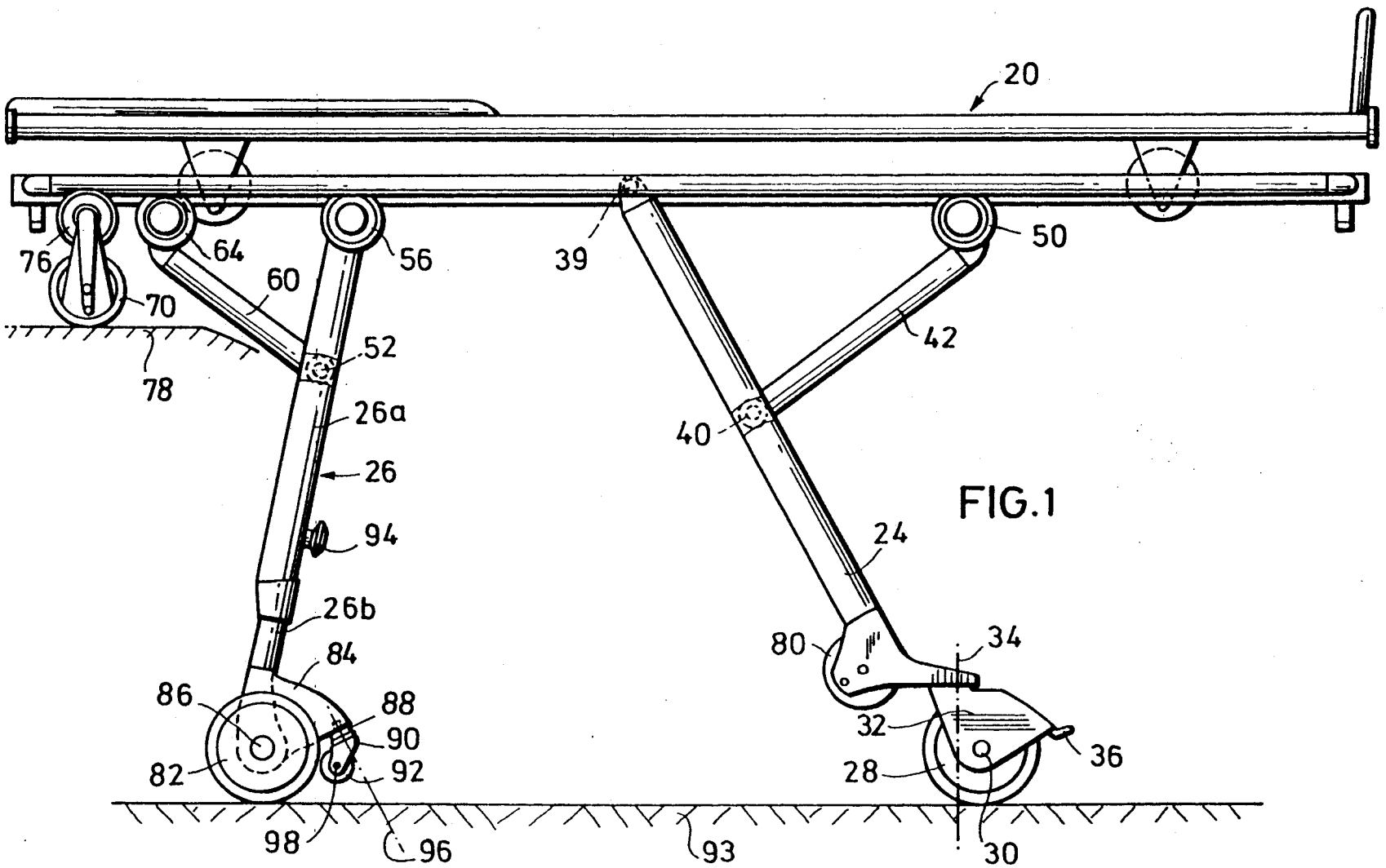
FIG. 1 a lateral view of the carriage resting on the front castors and the rear steering rollers, FIG. 2 a top plan view of the carriage of FIG. 1, FIG. 3 a lateral view of the carriage resting on the front and the rear steering rollers, FIG. 4 an up-scaled view of the castor and the steering roller of one front leg, FIG. 5 a view of the castor and the steering roller in the direction of the arrow V in FIG. 4, and FIG. 6 a lateral view of the front portion of the carriage in the folded state with a stretcher thereon.
Figure 2:
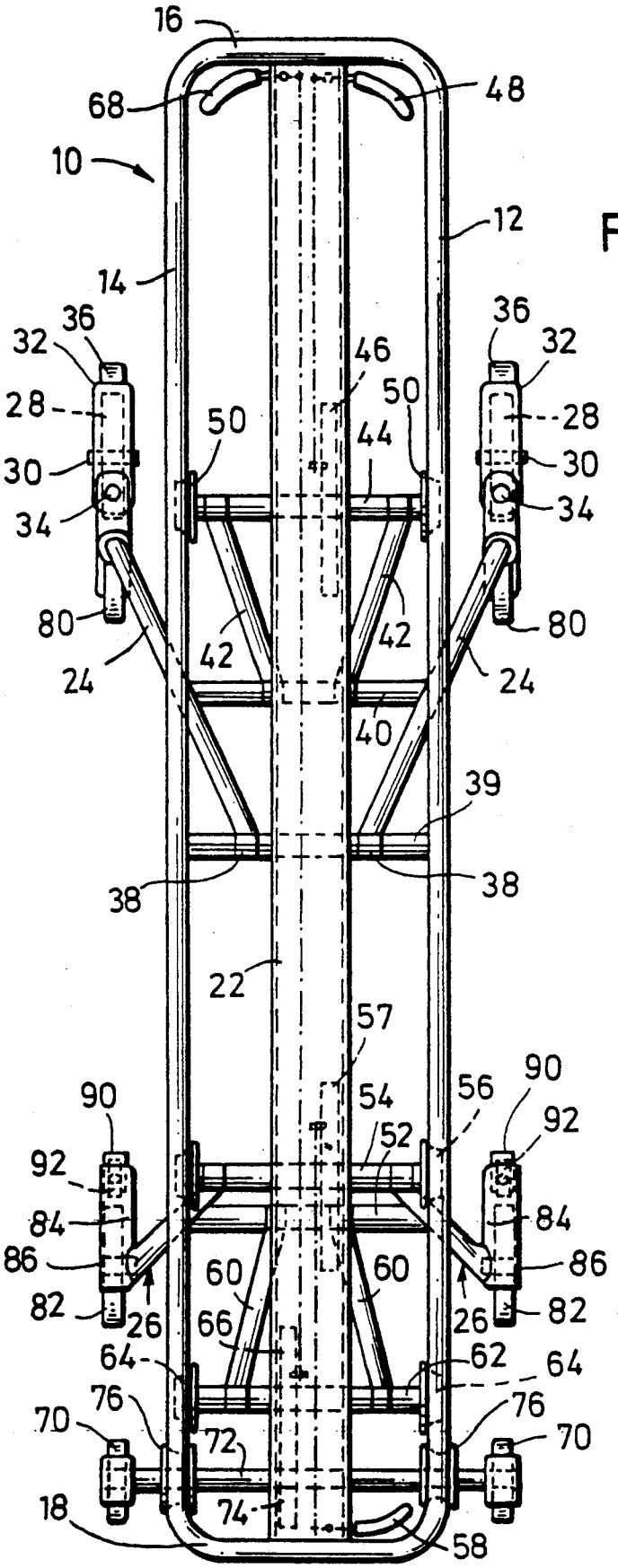

FIGS. 1 and 2 show the carriage in lateral and top plan view, respectively. The carriage has a frame 10 that consists of two longitudinal bars 12, 14 and two transversal bars 16, 18. On the frame 10, there is arranged a stretcher 20 (illustrated only in FIG. 1) that is detachably provided at the frame 10 in a manner not described and illustrated in detail. In the middle between the two longitudinal bars 12, 14 and in parallel thereto, a hollow strip 22 extends that has its ends connected to the transversal bars 16, 18 and shows two adjacent (first and second) channels open in the downward direction, in which two sliding members are arranged, respectively.

Further, the carriage has two rear legs 24 and two front legs 26 that are hinged at the frame 10. At the free ends of the rear legs 24 pivotable rear steering rollers 28 are arranged. Each steering roller 28 is fixed at a branched support 32 for pivotal movement about a horizontal axis 30, which support is supported in turn at a rear leg 24 for pivotal movement about a vertical pivot axis 34.

Integrated in the branched supports 32 are respective locking brakes of which FIG. 1 only illustrates the foot-operated actuator 36 for locking or braking the steering roller 28. Through stationary bearings, the two rear legs 24 are pivotably supported at a transversal rib 39 connecting the two longitudinal bars 12, 14 and connected in their central portion by a transversal rib 40. Two rear supporting rods 42 are hingedly connected with these transversal bar 40, the free ends of this rods being connected by a transversal rod 44 arranged immediately below the frame 10.

Transversal rod 44 is rotatably connected to a sliding member 46 that is displaceably arranged in the first channel of the hollow strip ∠∠ wherein it may be locked in several positions. By disengaging a disengaging lever 48, provided in the area of the transversal bar 16, the first slide member 46 may be disengaged so that the rear legs 24 may be pivoted around the hinges 38 below the frame 10 with the transversal rod 44 being longitudinally displaced. The transversal rod 44 has its ends provided with rollers 50, respectively, which roll on the undersurfaces of the longitudinal bars 12, 14, thus providing a support for the rear legs 24 on the longitudinal bars 12, 14.

The front legs 26 are centrally connected by a transversal rod 52 (indicated in FIG. 1). At their upper ends, the front legs 26 are connected by a further transversal rod 54 having respective end rollers 56, which roll on the underside of the longitudinal bars 12, 14. The transversal rod 54 is hinged to a sliding member 57 that is also guided for longitudinal displacement in the first channel of the hollow strip 22. This sliding member 57 may be locked disengagably at the hollow strip 22 by means of an actuator lever 58 arranged in the area of the transversal bar 18.

Two front supporting rods 60 are rotatably connected to the transversal rod 52 of the front legs 26, the free ends of rods 60 being connected by means of a further transversal rod 62 arranged immediately below the frame 10 and having rollers 64 at its two ends that contact the underside of the longitudinal bars 12, 14. The transversal rod 62 is rotatably supported at a sliding member 66 that is guided for longitudinal displacement in the second channel of the hollow strip 22 in which it may be locked disengagably. The locking and the disengaging of the sliding member 66 is performed with a lever 68 provided at the rear transversal bar 16.

By disengaging the locking of the sliding member 66, the front legs 26 can be pivoted upward for folding the carriage, the front legs 26 rotating about the rollers 56 at the upper transversal rod 54 of the front legs 26.

For setting down the frame 10 when pushing the carriage onto the platform of an ambulance, set-down rollers 70 are provided in the area of the front transversal bar 18. These set-down rollers 70 are rotatably supported at both ends of a transversal rod 72 which is connected to a sliding member 74 that is guided displaceably in the second channel of the hollow strip 22. The transversal rod 72 has further rollers 76 that contact the underside of the longitudinal bars 12, 14. The transversal rod 72 is resiliently biased towards the front transversal bar 18, i.e. it is guided longitudinally displaceable at the frame 10.

In order to set the carriage down on the platform of an ambulance, the frame 10 is set down on the platform 78 with the set-down rollers 70. When the locking of the front support rods 60 is disengaged, the front legs 26 are pivoted upward and rearward around the rollers 56 into a position right below the frame 10, as soon as the front support rods 60 and the legs 26 hit the rear end of the platform 78. In the same manner, the rear legs 24 pivot upward to a position below the frame 10, with the rear support rods 42 being disengaged, as soon as they hit the rear end of the platform 78.

Figure 6:
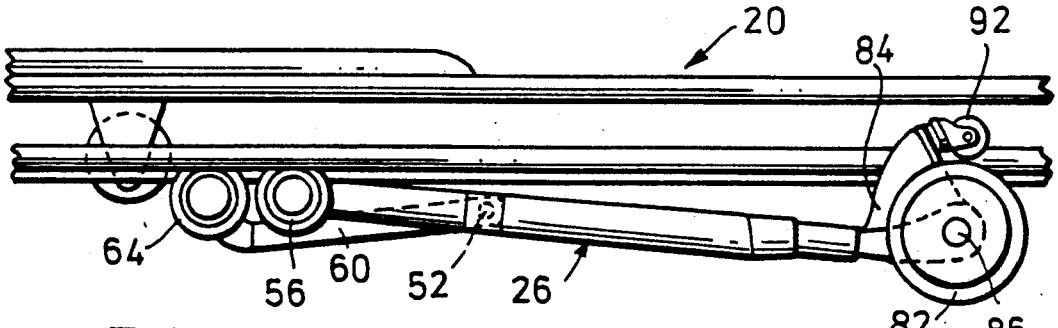

When the entire carriage has been pushed onto the platform 78, the set-down rollers 70 are located at the rear end of their path of displacement that they have traveled against the force of the resilient bias on rod 72 while the carriage had been pushed onto the platform 78. FIG. 6 illustrates the state of the front portion of the carriage with the front legs 26 pivoted upward. When the carriage is folded, the rear legs 24 rest on the platform 78 on rollers 80 that are rotatably supported at the rear legs 24 in the area of the rear steering rollers 28.

The lower ends of the front legs 26 have fixed roller members 82 that are supported at supports 84, which are connected to the front legs 26. Roller members 82 are mounted for rotation about a horizontal axis 86. The live ring 88 of a steering roller support 90 is connected to the support 84 and support 90 is branched or bifurcated and rotatably holds a steering roller 92. The supports 84 are designed as plates projecting rearward beyond roller members 82. The live rings 88 are mounted at the rear ends of these plates and extend rectangular thereto. Thus, when the legs 26 are pivoted down, the front steering rollers 92 are located between the rollers 82 and the rear steering rollers.

Depending on the pivotal position of the front legs 26, the carriage rests on the rear steering rollers 28 and either only on the front rollers 82 or the front steering rollers 92. Pivoting the front legs 26 for moving the carriage either on the rollers 82 or the front steering rollers 92 is done by disengaging the sliding member 57 which, when locked, inhibits a longitudinal displacement of the front legs 26 relative to the frame 10. When the front legs 26 are disengaged and the front support bars 60 are locked, the front legs 26 may be pivoted about their transversal bar 52, the upper ends of the front legs 26 being guided immediately below the frame 10 through rollers 56.

Figure 3:
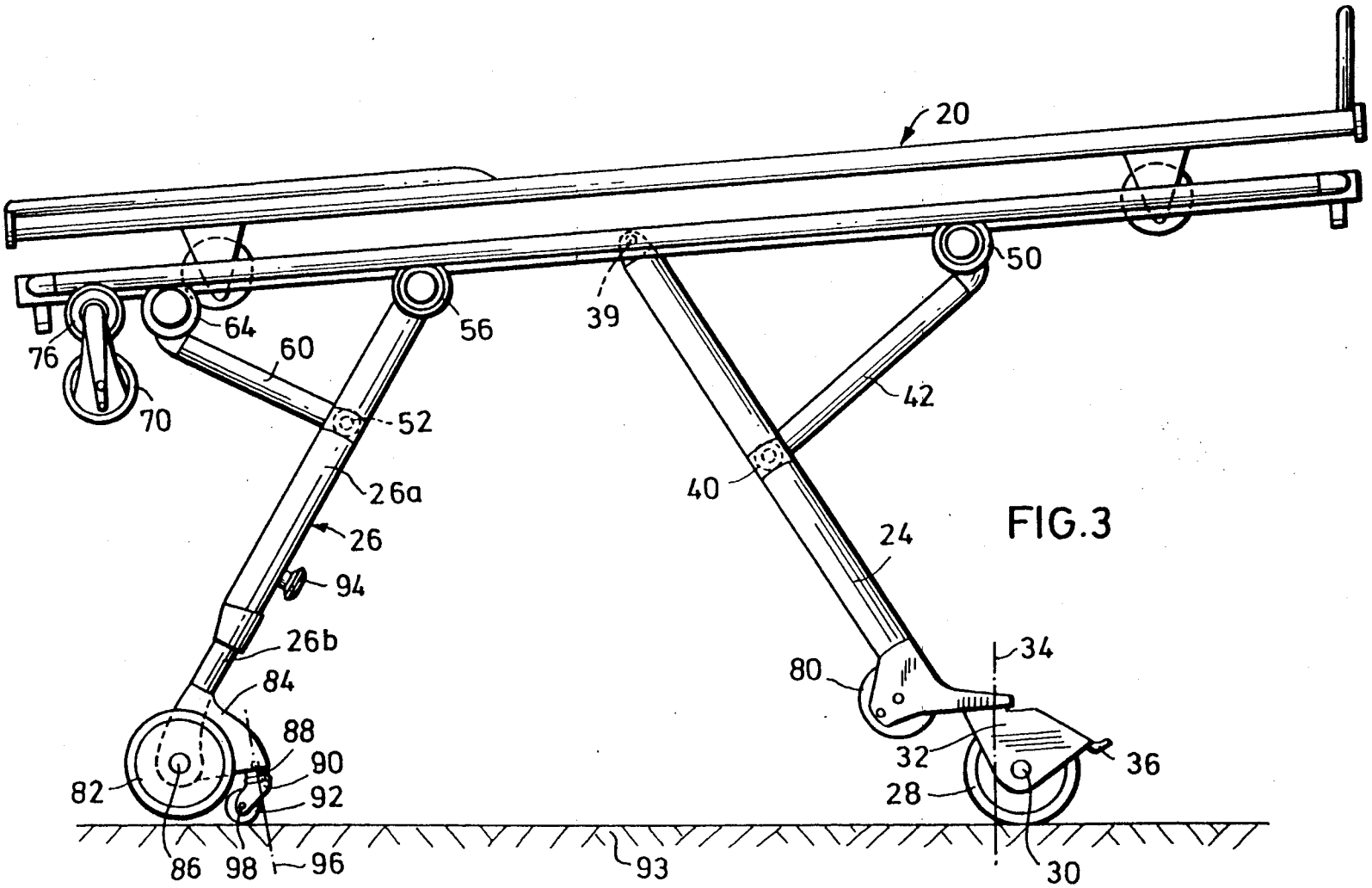

Pivoting the front legs 26 causes a lowering of the front end of the carriage as evident from a comparison of FIGS. 1 and 3. These Figures show on which rollers (fixed rollers or front steering rollers) of the front legs 26 the carriage rests, depending on the pivotal position of the front legs 26. In a pivotal position in which the frame 10 is in parallel to the ground 93, the carriage may be moved on the rollers 82 and the rear steering rollers 28 (FIG. 1). In a pivotal position of the front legs 26 in which the front end of the carriage is lowered, the running surfaces of the front steering rollers 92 contact the ground 93, while the fixed rollers 82 are at a spaced distance to the ground 93 (FIG. 3).

In both pivotal positions according to FIGS. 1 and 3, the front legs 26 are securable against longitudinal displacement relative to the frame 10 by locking the sliding member 57 in the hollow strip 22. In order to vary the degree of the lowering of the front end of the carriage, the front legs 26 may be locked in several pivotal positions in which only the front steering rollers 92 contact the ground 93. When all four legs of the frame 10 rest on the steering rollers 28 and 92, the carriage may easily be maneuvered through narrow curves or be shifted in the transversal direction of the frame 10 (i.e. laterally).

In other words, rollers 82 are mounted to frame 10 for carrying frame 10 along a first directional path while the front and rear steering rollers 92, 28 carry frame 10 along a plurality of directional paths transverse to the first directional path of the fixed front rollers 82.

In order to be able to steer the carriage both at the front and the rear end, one must only lower the front end of the frame 10 by actuating the releasing lever 58 for the locking of the front legs 26. This lowering is very easy to do and known from conventional carriages because of the possibility to transport patients in shock in an appropriate lowered position. Inasfar, no constructional modifications need be effected to achieve a steerability of the carriage at the front legs 26.

In order to adapt the carriage to platforms 78 of different heights in the different ambulances, the front legs 26 are variable in length. To that end, each front leg 26 consists of an upper part **26*a* and a lower part 26*b*, guided longitudinally displaceable therein, at the end of which lower part the support 84 is mounted. The two upper parts 26*a* are connected through the transversal rods 52 and 54. The lower part 26*b* may be secured against longitudinal displacement in the upper part 26*a* by means of a threaded bolt with a handwheel 94 provided in the upper part 26*a***.

When the length of the front legs 26 is varied, the parallel position of the frame 10 to the ground is obtained by locking the rear support rods 42 at the frame 10 in a position other than the one shown in FIG. 1. By doing so, the pivotal position of the rear legs 24 is also different when the frame 10 is horizontally orientated. If the front legs 26, with their length changed, are pivoted into the pivotal position of FIG. 3, the vertical pivot axis 96 will not be perpendicular to the ground. This is disadvantageous, however, because of the trailing properties of the front steering roller 92 (the vertical pivot axis 96 does not intersect the horizontal axis of rotation 98).

Figure 4:
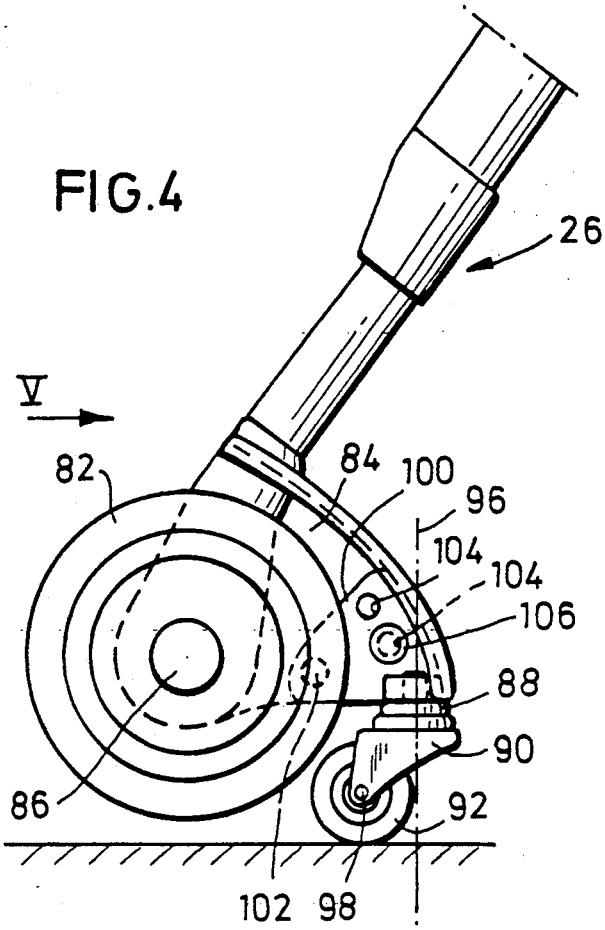
Figure 5:
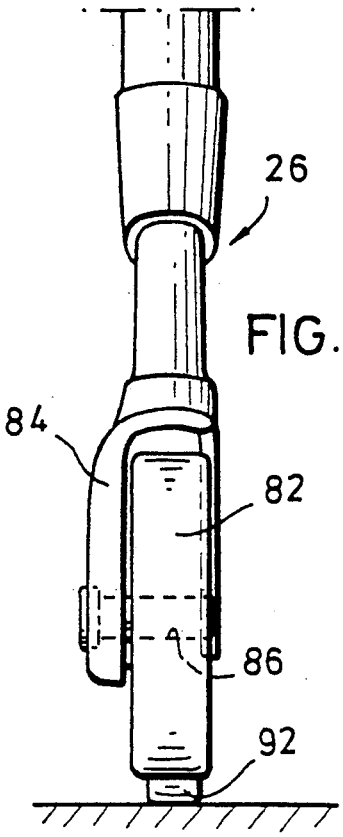

In case of front legs with adjusted length, it is possible to obtain the perpendicular orientation of the pivot axis 96 to the ground by pivoting the front legs 26 of the carriage. In order to do so, the front legs 26 may be locked in several pivotal positions at the frame 10, in which only the front steering rollers 92 contact the ground 93. In addition, the relative position of the branched or bifurcated support 90 for a steering roller 92 and of the support 84 are adjustable, as shown in FIG. 4. To this avail, the support 84 is provided with a pivotable plate 100 that is held at the support 84 for rotation about an axis 102.

The live ring 88 of the steering roller 92 is mounted on the plate 100. The support 84 and the plate 100 each have a plurality of equidistantly spaced bores 104 that are arranged on a respective circle having the same radius and having the axis 102 as the center. The plate 100 may be fixed to the support 84 by means of a bolt 106 extending through two superposed bores in the plate 100 and the support 84. By pivoting the plate 100 around the axis 102 relative to the support 84, one may adjust the tilt of the support 90 of the front steering roller 92.

Due to this adjustability of the front steering rollers 92, it is possible for instance that, when the length of the front legs 26 is changed, the pivot axes 96 will always extend perpendicular to the ground in the first pivotal position in which the front steering rollers 92 contact the ground 93, the front end of the frame 10 being lowered. Regardless of the length of the front legs 26, this ensures that the pivot axes 96 will extend perpendicular to the ground in the first pivotal position of the front legs 26. Thus, it is very easy to adjust the carriage for a better steerability at the front and the rear end thereof.

As can be seen in FIG. 2, the rollers 82 and the front steering rollers 92 have the same track width. Like the rollers 82 and the rear steering rollers 28, the front steering rollers 92 are located at both (outer) sides of the frame 10 when the front and rear legs 26, 24 are pivoted upward. Further, the front steering rollers 92 are arranged at such a distance from the rollers 82 that the steering rollers 92 are located immediately below the stretcher 20 when the carriage is folded, as can be seen from FIG. 6.

The invention has been described by way of a special embodiment of a carriage wherein the legs are pivoted upward automatically when the carriage is pushed onto the platform of an ambulance. However, additional steering rollers may be provided at the front legs of any other type of carriage. Besides the fixed rollers, one may also provide steering rollers at one of the pairs of legs (the rear or front legs) in particular with such carriages wherein the legs have to be pivoted upward manually before the carriage is pushed onto the platform, or with movable sickbeds.

I claim:

1. A carriage for supporting a stretcher, said carriage comprising:

(a) frame means, front legs pivotally mounted to the frame means, and means for locking the front legs in at least two pivotal positions with respect to the frame means, (b) the front legs including first front roller means mounted to carry the frame means long a first directional path and front steering roller means mounted to carry the frame means along a plurality of directional paths transverse to the first directional path, and (c) the location of the front roller means and the front steering roller means with respect to each other on the front legs being effective to cause only the first front roller means to support the frame means when the front legs are in one of the pivotal positions and to cause only the front steering roller means to support the frame means when the front legs are in the other pivotal position.

2. A carriage as defined in claim 1 wherein the front steering roller means has the same track as the first front roller means and is disposed at a location on the front legs to face the rear legs mounted to the frame means.

3. A carriage as defined in claim 1 wherein the front legs include means for supporting the first roller means, and the front steering roller means are disposed at said supporting means for the first roller means.

4. A carriage as defined in claim 1 wherein the first front roller means includes roller members mounted to rotate about a fixed axis of rotation and the front steering roller means includes roller members mounted to rotate about a rotational axis and to pivot about a pivotal axis extending in a direction transverse to the direction of said rotational axis.

5. A carriage as defined in claim 4 wherein the front legs include support means for adjustably supporting the front steering roller means and changing the disposition of the pivotal axis with respect to the rotational axis of the front steering roller members.

6. A carriage as defined in claim 1 wherein the front legs include support means for the first front roller means and the front steering roller means is disposed on said support means.

7. A carriage as defined in claim 1 wherein said front leg locking means is effective to lock the legs with respect to the frame means in several pivotal positions in which pivotal positions the frame means is supported only by the front steering roller means.

8. A carriage for supporting a stretcher, said carriage comprising:

(a) a frame, front legs pivotably mounted to the frame, and disengagable locking means for locking the front legs in at least two pivotal positions with respect to the frame, (b) the front legs including first roller members and front steering roller members, (c) said first roller members and front steering roller members being disposed with respect to each other on said front legs to cause the frame to be supported only by the first roller members when the front legs are in one of said pivotal positions and to cause the frame to be supported only by the front steering roller members when the front legs are in the other of said pivotal positions.

9. A carriage as defined in claim 8 wherein the front steering roller members have the same track width as the first roller members and are disposed on the front legs to face rear legs mounted to the frame.

10. A carriage as defined in claim 8 wherein the front legs include support devices which rotatably support the first roller members, and the front steering roller members are located at said support devices.

11. A carriage as defined in claim 8, wherein mounting means adjustably support the front steering roller members on the front legs for changing the disposition of a pivotal axis for said front steering roller members.

12. A carriage as defined in claim 11 wherein the front legs include support devices which rotatably support the first roller members, and said mounting means adjustably support the front steering roller members to said support devices for the first roller members.

* * * * *

UNITED STATES PATENT AND TRADEMARK OFFICE

CERTIFICATE OF CORRECTION

PATENT NO. : 5,015,024

DATED : May 14, 1991

INVENTOR(S) : Guenter Bloemer

It is certified that error appears in the above-identified patent and that said Letters Patent is hereby corrected as shown below:

On the title page, item [73], change the spelling of the Assignee from "Stollenwerk Fabrik fur Sanitatsaustungen Hans Stollenwerk & Cie GmbH & Co.," to --Stollenwerk Fabrik für Sanitätsausrüstungen Hans Stollenwerk & Cie GmbH & Co. --, Signed and Sealed this Twelfth Day of October, 1993

*Attest:*

Bruce Lehman

BRUCE LEHMAN

*Attesting Officer*

*Commissioner of Patents and Trademarks*